US011083272B2

(12) United States Patent
Ma

(10) Patent No.: US 11,083,272 B2
(45) Date of Patent: Aug. 10, 2021

(54) BEARD NECKLINE GUIDE APPARATUS AND METHOD

(71) Applicant: Teng Ma, Providence, RI (US)

(72) Inventor: Teng Ma, Providence, RI (US)

( * ) Notice: Subject to any disclaimer, the term of this patent is extended or adjusted under 35 U.S.C. 154(b) by 129 days.

(21) Appl. No.: 16/356,867

(22) Filed: Mar. 18, 2019

(65) Prior Publication Data

US 2020/0069026 A1 Mar. 5, 2020

Related U.S. Application Data

(63) Continuation-in-part of application No. 29/661,511, filed on Aug. 28, 2018, now abandoned.

(51) Int. Cl.
*A45D 24/36* (2006.01)

(52) U.S. Cl.
CPC ..... *A45D 24/36* (2013.01)

(58) Field of Classification Search
CPC ..... A45D 27/42; A45D 24/36; A45D 44/22; A41B 13/10
See application file for complete search history.

(56) References Cited

U.S. PATENT DOCUMENTS 889,073 A * 5/1908 Walbridge ..... A41B 13/10 2/49.1
1,517,166 A * 11/1924 Powers ..... A45D 24/36 132/214
1,615,408 A 1/1927 Scott
1,629,741 A * 5/1927 Schick ..... A45D 24/36 132/214
1,669,983 A * 5/1928 Humphrey ..... A41B 13/10 24/9
1,907,063 A * 5/1933 Golanke ..... A45D 24/36 132/214
2,539,198 A * 1/1951 Metzler ..... A45D 24/36 132/214
2,808,840 A * 10/1957 De Santis ..... A45D 24/36 132/214
2,859,446 A * 11/1958 Older ..... A41B 13/10 2/52
3,180,341 A * 4/1965 Dumont ..... A45D 24/36 132/213
3,299,440 A * 1/1967 Grable ..... A41B 13/10 206/390

(Continued)

*Primary Examiner* — Nicholas D Lucchesi
(74) *Attorney, Agent, or Firm* — Lamon Patent Services; Cynthia S. Lamon

(57) ABSTRACT

A beard trimming template is provided comprising a first elongated portion formed from a first straight edge and a second straight edge, the first and second edges being parallel. A second elongated portion has third and fourth straight edges, the third and fourth edges being parallel. A main body is formed by a radius bridging ends of the second and third straight edges proximal to the main body, and an apex, opposite the radius, formed by ends of the first and fourth straight edges proximal to the main body joining at a right angle. The first and second straight edges are connected via a fifth straight edge forming a first width edge, and the third and fourth straight edges are connected via a sixth straight edge forming a second width edge, wherein the first and second width edges are equal in dimension and distal to the main body.

10 Claims, 5 Drawing Sheets

(56) References Cited

U.S. PATENT DOCUMENTS

| | | | | | |
|---|---|---|---|---|---|
| 3,332,547 | A * | 7/1967 | Buss | A41B 13/10 | 206/526 |
| 3,857,116 | A * | 12/1974 | Meeker | A41B 13/10 | 2/50 |
| 4,862,518 | A * | 9/1989 | Williams | A41B 13/10 | 2/49.1 |
| 5,186,190 | A * | 2/1993 | Hirzel | A45D 40/30 | 132/216 |
| 6,070,268 | A * | 6/2000 | Holland | A41B 13/10 | 2/49.1 |
| D692,186 | S * | 10/2013 | Phillips | D29/108 | |
| D736,461 | S | 8/2015 | DoSouto | | |
| D785,868 | S | 5/2017 | Lal | | |
| 9,883,727 | B2 * | 2/2018 | Chandler | A45D 27/42 | |
| 10,271,582 | B1 * | 4/2019 | Kipchaba | A41B 13/10 | |
| 2013/0213429 | A1 * | 8/2013 | Allen | A45D 24/36 | 132/214 |
| 2015/0101098 | A1 * | 4/2015 | McNeill | A41B 13/10 | 2/46 |
| 2015/0265026 | A1 * | 9/2015 | Yeheskel | A45D 24/36 | 132/214 |
| 2016/0235180 | A1 * | 8/2016 | Brunett | A45D 24/02 | |
| 2017/0119127 | A1 * | 5/2017 | Krost | A45D 27/42 | |
| 2017/0231297 | A1 * | 8/2017 | German | A41B 13/10 | 2/206 |
| 2018/0000220 | A1 * | 1/2018 | Leydecker, Jr. | A45D 27/42 | |
| 2018/0020744 | A1 * | 1/2018 | Davidson | A45F 5/02 | 2/49.1 |
| 2019/0053599 | A1 * | 2/2019 | Villa | A45D 27/42 | |
| 2019/0223573 | A1 * | 7/2019 | Maroun | A45D 44/00 | |
| 2019/0231598 | A1 * | 8/2019 | Laghi | A61L 26/0052 | |

* cited by examiner

BEARD NECKLINE GUIDE APPARATUS AND METHOD

CROSS-REFERENCE TO RELATED DOCUMENTS

This application claims priority to U.S. patent application Ser. No. 29/661,511, "Beard Trim Guide" filed Aug. 28, 2018 which is hereby incorporated by reference.

BACKGROUND OF THE INVENTION

1. Field of the Invention

The present invention is in the field of beard grooming and trimming products and pertains particularly to methods and apparatus for creating a template-based beard line boundary and shaving below and up to the boundary.

2. Discussion of the State of the Art

There are a variety of hairline shaping tools that serve as a template available for facial and neckline grooming. A user may utilize a hairline shaping tool to create a desired beard line on face or neck, side burns, back of the neck, or any other body areas where a hairline is present. These shaping tools that are known in the art have several disadvantages, making them not suitable for creating a nice neckline. The majority of these shaping tools are rigid and difficult to conform and fit to a face in a conformable manner. Some shaping tools are wearable around neck but only for trimming the hair on the back of the neck.

Front necks are a specific problem area to shave correctly as curves are quite evident. A few of these known tools may be somewhat flexible, but still fall short of making conformable contact, particularly with the curve of a neck line. Current templates must be held firmly in place with one hand while in use and it is difficult to get a consistent and symmetric neckline and it is also challenging to trim beard with one hand while holding the template with the other hand.

Therefore, there is a need for a beard trimming template that is flexible and in some embodiments elastic enabling the tool to be conveniently positioned on the neck at a desired elevation and secured thereto in a simple and conformable manner with respect to the neck line. This template is also wearable and hands-free so that once you get it set it'll stay put so you don't have to hold it with one hand and shave with the other. It is convenient to trim beard with both hands. The present invention embodies an improved neckline guide apparatus and method of use thereof.

BRIEF SUMMARY OF THE INVENTION

The principal object of this invention is to provide a beard neckline guide apparatus which allows a user to trim precisely his own neck beard while creating a neckline by using razors, trimmers, clipper, etc. Another object of the present invention is to provide symmetrical and customized neckline shapes. An additional object of this invention is to provide a wearable beard neckline guide apparatus which allows for an efficient, easy to adjust, easy to use tool without the need to hold the guide with one hand. In summary, the main object of this invention is to provide a beard neckline trimming template apparatus which allows a man to accurately and easily trim a symmetric beard neckline. The device according to this invention includes a flexible and adjustable shaving template and an elastic band for securing the shaving template in the desired location on the neck. The flexible shaving template is adjustably coupled to the elastic or inelastic band at the opposing ends of the shaving template.

One embodiment of the present invention provides a beard trimming template comprising a first elongated portion formed from a first straight edge having a first length, a and a second straight edge having a second length, the first and second straight edges positioned parallel to each other.

A second elongated portion is also provided in this embodiment having a third straight edge and a fourth straight edge, the third and fourth straight edges positioned parallel to each other. Aa main body is formed by a radius connecting ends of the second and third straight edges proximal to the main body. In this embodiment an apex, opposite the radius, may be formed by ends of the first and fourth straight edges proximal to the main body joining at a right angle. In this embodiment, the first and second straight edges may be connected via a fifth straight edge forming a first width edge between the first and second straight edges and the third and fourth straight edges may be connected via a sixth straight edge forming a second width edge. Also in this embodiment, the first and second width edges are equal in dimension and are distal to the main body.

In another embodiment, the first and fourth straight edges may be equal in length. Another embodiment provides that the first and second elongated portion include at least two slit openings at a position distal to the main body and parallel to the first and second width edges, the slit openings enabled to accept a separate end of an attachment strap enabled to hold the template on a user's head. In this embodiment, the strap may be elastic. This embodiment also provides that the template is manufactured from semi-rigid plastic or metal.

Another embodiment provides that the template has a uniform thickness creating a radiused edge designed to be positioned adjacent to a user's neck under a user's chin. This embodiment also provides that, once positioned, the template maintains position without aid from the user.

A method for using a hands-free beard trimming template is also provided, comprising creating a radiused edge on a main body, the radius having opposite ends, one each connected to separate ends of a first and third straight edge, the first and third straight edges positioned orthogonal to each other and extending away from the main body forming a first elongate member. An apex is provided opposite the radius of the main body by joining proximal ends of a first and fourth straight edge, the first and fourth straight edge positioned orthogonal to each other.

Providing a first width edge joins ends of the first and second straight edges, with the first width edge positioned distally from the main body and providing a second width edge which joins ends of the third and fourth straight edges, the second width edge positioned distally from the main body.

Next, the user places the radiused edge orthogonal and adjacent to the user's neck, under a chin of the user, implementing a razor or other trimming device trimming a beard portion exposed by the template.

One embodiment provides an elastic strap attached to slit openings proximate to the first and second width edges enabling a user to use the razor to trim the beard while not holding the template, or "hands-free". In this embodiment, the template is manufactured from a semi-rigid plastic or metal enabling the template to maintain position on the user's neck.

DETAILED DESCRIPTION OF THE INVENTION

The inventor provides a unique shaving template apparatus that may be manipulated to form a beard trim line along at least one edge of the shaving template apparatus. It is a goal of the present invention to provide a means for men who sport or wear beards to be able to identify a desired shaving boundary defining the underside neck line of their beards and to shave their beards accordingly using the template. It is another goal of the invention that a means is included to enable adjustment of and manipulation of the apparatus to provide for lower or higher beard line boundaries as may be desired by a user of the apparatus. An additional goal is to provide a wearable and hands-free shaving template apparatus. The present invention is described in enabling detail using the following examples, which may describe more than one relevant embodiment falling within the scope of the present invention.

Figure 1A:
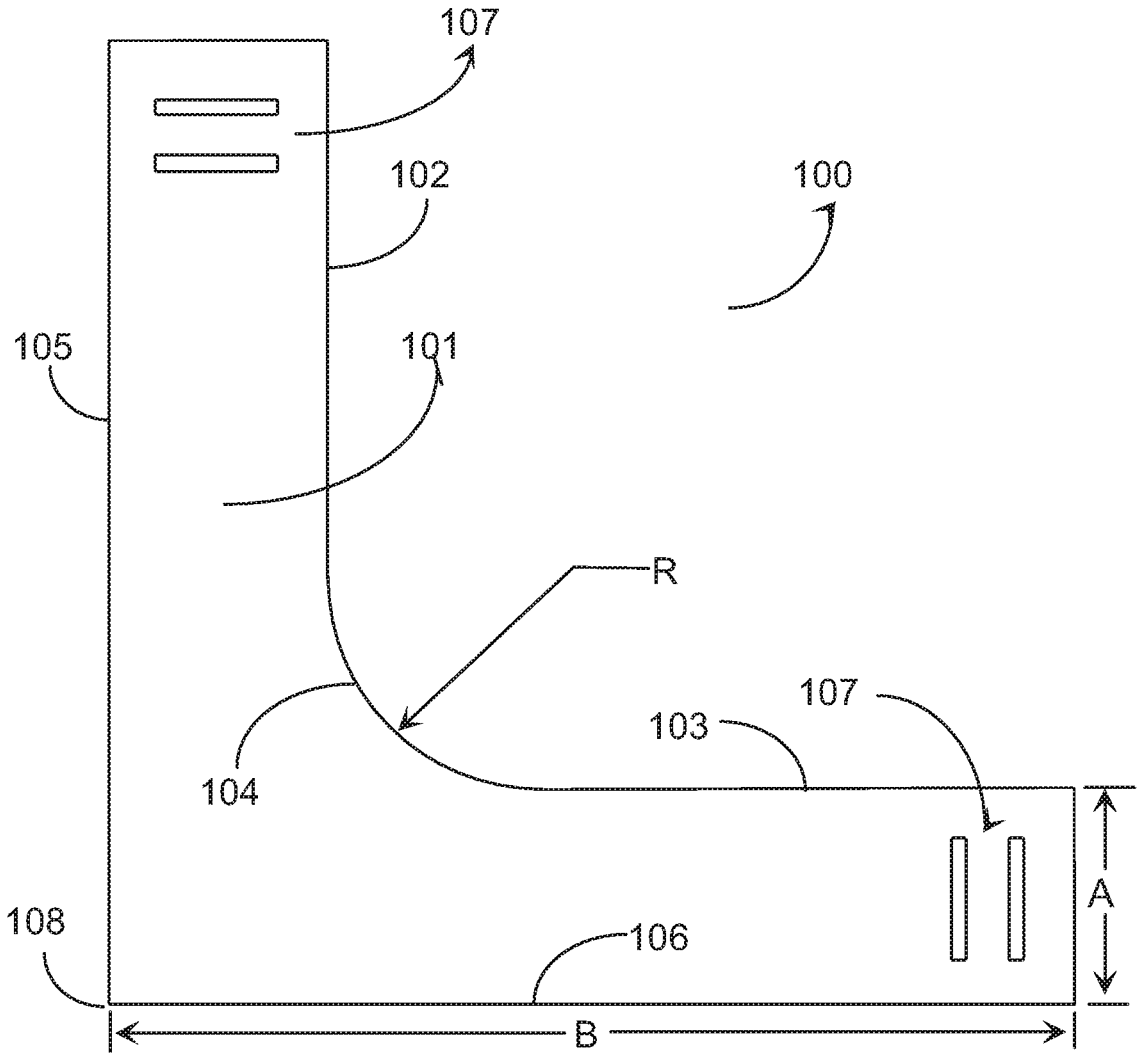
FIG. 1A is an overhead view of a beard shaving template according to an embodiment of the present invention.
Figure 1B:
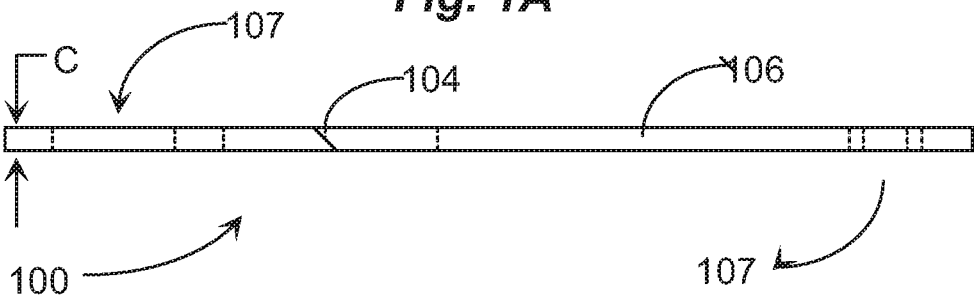
FIG. 1B is an edge view of the template of FIG. 1B.

FIG. 1A is an overhead view of a beard shaving template 100 according to an embodiment of the present invention. FIG. 1B is an edge view of template 100 of FIG. 1B. Referring now to FIG. 1A, template 100 is adapted by selecting rigid and thin material to be formable to a user's beard line beneath the chin. Template 100 may be manufactured from a stiff and thin material 101 including plastic or metal wherein the selected material exhibits a flexibility sufficient to allow the template to conform, at least along one edge, around a user's neck line forming a desired beard shaving boundary line. Template 100 may also be manufactured from a stiff rubber or polymer material that provides at least some elasticity enabling a user to manipulate the template by stretching the template at least in one embodiment of the present invention.

Template 100 may be cut, trimmed or stamped from a relatively thin material 101, which may be a plastic, metal, rubber, or a composite including any of plastic, metal and rubber. Template 100 has a straight outer edge 105 and a straight outer edge 106 culminating at a point. Edge 105 and 106 are substantially orthogonal (90 degrees nominally) to one another but may vary in angle presentation to less than 90 degrees to about 50 degrees or past 90 degrees to about 150 degrees. Edge length B may be approximately 6 inches long and may apply to both straight edges 105 and 106. In one embodiment, scale markings, similar to a US or metric ruler, (not illustrated) may be provided to illustrate the length along the straight edges such as a mark at every inch of length for example. Template 100 may be stamped from a six inch square of material 101.

Template 100 includes a shaving edge line comprising a substantially straight template edge 102, a substantially straight template edge 103, and a radiused edge 104 bridging the two straighter edges wherein the radiused edge 104 conforms to the front portion of a user's neckline while edges 102 and 103 cover either side of the user's neckline. In this example, radius R of radiused edge 104 is approximately one inch. Template 100 may be provided larger or smaller in size within reason without departing from the spirit and scope of the present invention. Template 100 is adapted to be worn by a user and includes an elastic strap (not illustrated here). Template 100 includes a pair of substantially parallel slots placed through material 101 and disposed at the ends of the device for anchoring an elastic strap. A width dimension A may be about one and three eights inches. Width dimension A connects an end of edge 103 distally positioned away from radius 104 and end of edge 106 distally positioned from an apex or point 108 joining straight edges 105 and 106.

Referring now to FIG. 1B, template 100 has a material thickness C of approximately one-sixteenth of an inch. Thickness dimension C may be larger or smaller than one-sixteenth of an inch as may be desired depending on the material properties of the material used to fabricate the template. Radius edge 104 is revealed in hidden lines as are slot pairs 107 for anchoring an elastic strap.

Figure 2:
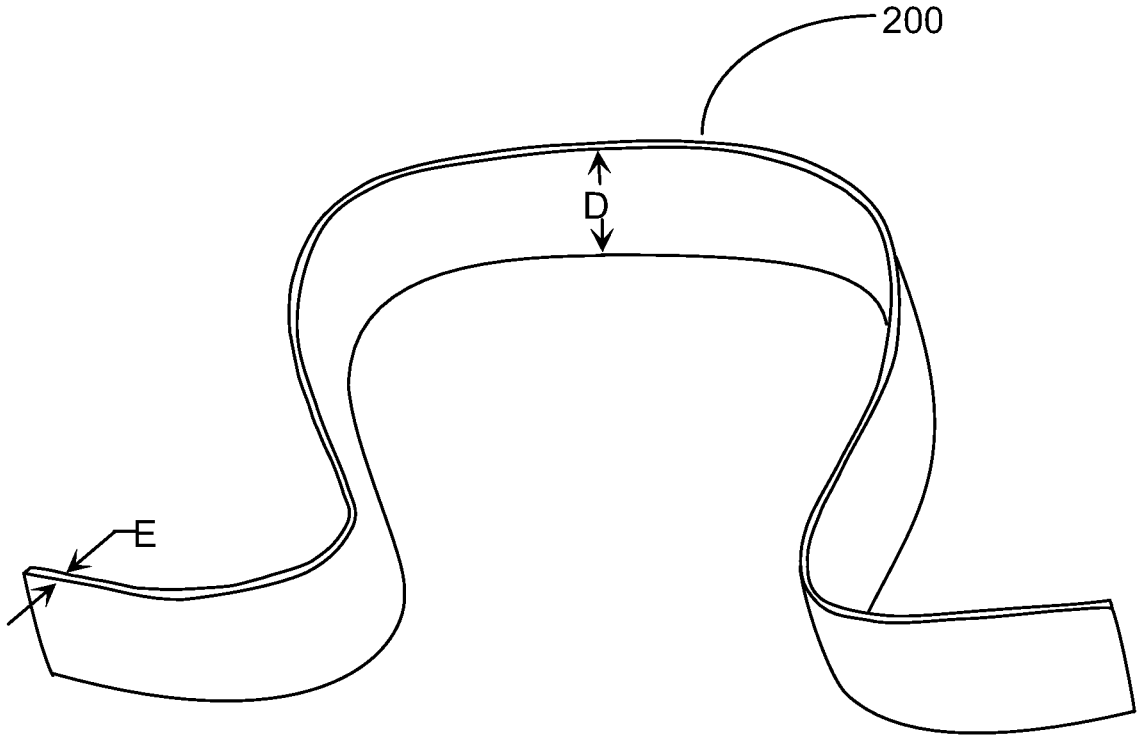
FIG. 2 is a perspective view of an elastic strip piece for enabling a user to wear the template of FIG. 1A.

FIG. 2 is a perspective view of an elastic slat piece 200 for enabling a user to wear template 100. Elastic strap piece 200 may be a standard rubberized material strap exhibiting a high degree of elasticity. The overall length of strap 200 may be about nineteen to twenty-four inches. However, shorter straps may be ordered if warranted. A width dimension D for strap 200 may be approximately five eights of an inch or so. The width dimension D is larger than the length dimension of parallel slots 107 of FIG. 1A so that adjustments in tension may be made and may hold without using hard or soft buckles, which may irritate a user. A thickness dimension E may vary according to material used but may be about one thirty-second of an inch or so.

In one embodiment, the elastic strap 200 may have two pieces each coupled or threaded through the opposing ends of the shaving template 100 of FIG. 1A. A coupling mechanism may be attached to the free ends of the elastic strap such that a user may connect the straps to form a loop including the template. In an embodiment, the coupling mechanism may be or include a hook surface and a loop surface which may be uncoupled (pulled apart) and coupled when pressed back together. In other embodiments, the coupling mechanism may be a buckle which may be uncoupled when pressed together. However a single strap is depicted herein as the most simple architecture requiring no adjustments once a user has set the tension at each template end by advancing or retarding the strap ends through the parallel slot pairs.

Referring now back to FIG. 1A for reference, strap 200 is designed to fit about a user's head leaving template 100 in contact with the user's neckline with the point created by outer edges 105 and 106 of FIG. 1A facing forward. The user may manipulate the point to raise or lower a desired beard line beneath the chin and jaw line of a user.

Figure 3:
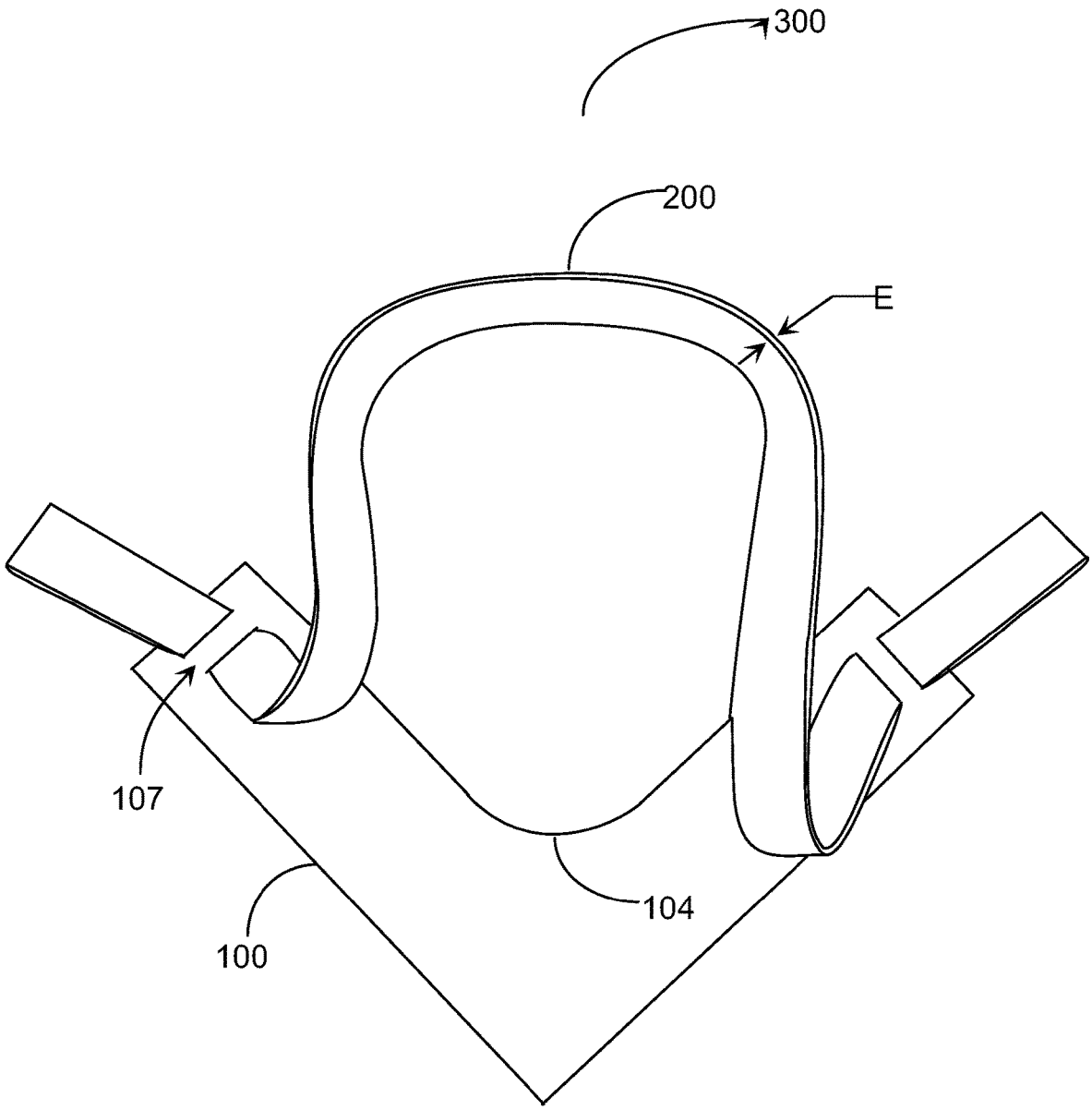
FIG. 3 is a front elevation view of a beard template apparatus 300 combining template 100 of FIG. 1A and strap 200 of FIG. 2.

FIG. 3 is a front elevation view of a beard template apparatus 300 combining template 100 of FIG. 1A and strap 200 of FIG. 2. Apparatus 300 may be worn about the user's head. Strap 200 having thickness E is attached to template 100 at both ends by inserting the strap ends through the parallel slot configurations 107. However some other embodiments may include two strap pieces that may be anchored to or coupled to the template and coupled together to form a loop as described further above. Apparatus 300 may be put over the head and worn about the neck before shaving as for staging the apparatus for use. Radiused edge 104 should hang down in the middle when worn and before use. The interfacing edges including radiused edge 104 may be collectively shaped or traced edges that produce a stylized design for the user's beard line. In this case the beard line is relatively straight.

Figure 4:
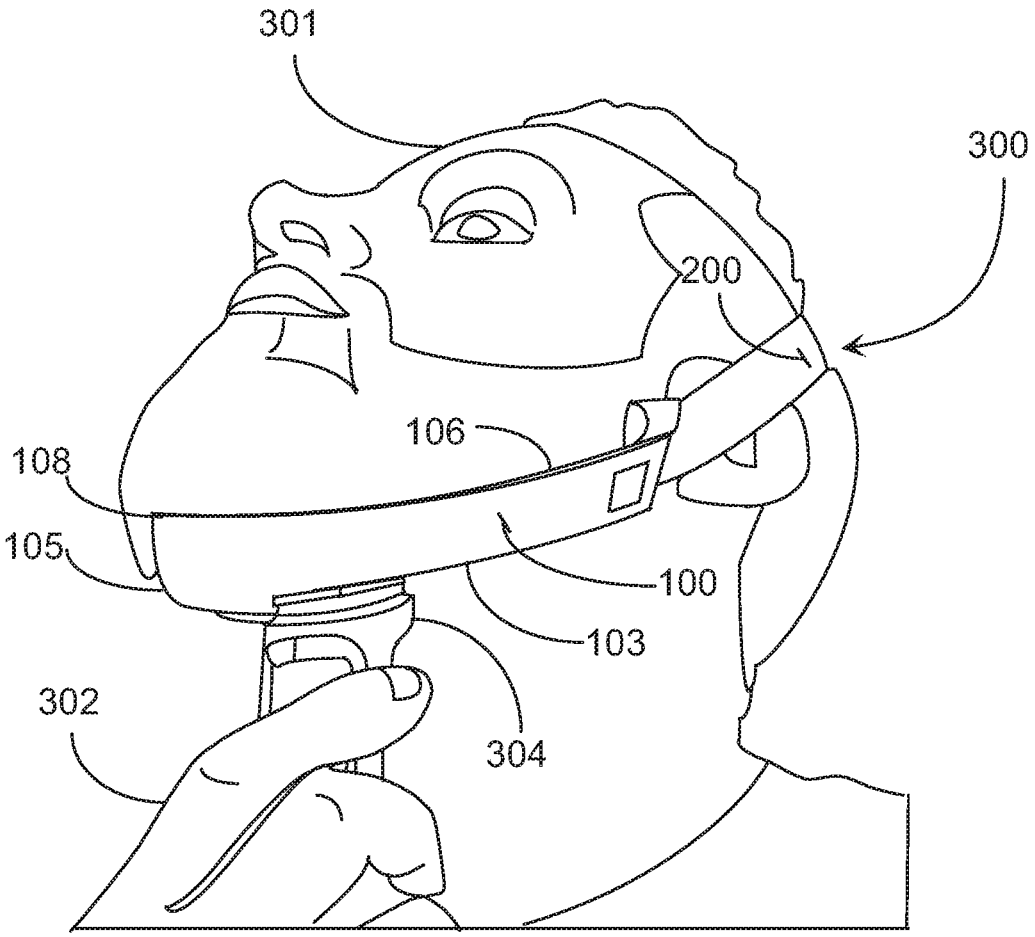
FIG. 4 is a side view of the beard template apparatus of FIG. 3 worn and enables hands-free trimming. by a use.

FIG. 4 is a side view of beard template apparatus 300 of FIG. 3 worn and manipulated by a user 301 engaged in shaping a beard line according to an embodiment of the present invention. User 301 may first attach and anchor elastic strap 200 to template 100 at both ends creating apparatus 300 and may place apparatus 300 over his head allowing the device to be worn momentarily like a pendant about the neck with the outer edges pointing down and away. When the user is ready to shave the beard line at the neck, the user may place the elastic strap 200 up over his head just in front of the ears as is depicted in this view. Once the user places the apparatus 300 under the chin, at the neckline, and the strap 200 is secured around a user's head, the apparatus 300 stays in place "hands-free" enabling a user to trim a beard in an upper front portion of the neck without having to keep a hand on the template. It is important to note herein that the template and the user may also adjust how tightly template 100 is held against the user's neckline after attaching the strap to the template. User 301, while looking in a mirror, may grab template 100 by the outer point or apex 108 of the template, and urge the point out and up to raise template 100 along the vertical line of the neck.

User 301 may adjust template 100 relative to how tight it holds to his neckline by lengthening or shortening strap 200. User 301 may then raise or lower template 100 to a desired elevation such that the interfacing inner edge of the template (edge 102, edge 103, and radiused edge 104) is at a desired elevation on the user's neck, typically above the Adams apple, but below the jaw line. Once placed, the template 300 will stay in place without the use of the user's hand, thereby enabling hands-free trimming, wherein the user need not hold the template 300 directly. In a preferred embodiment, the flexibility of the material (material 101, FIG. 1A) allows the template interfacing edges to make and hold contact conforming about the user's neck, the force of which may be ordered by adjusting strap 200 to increase or decrease tension.

Once user 301 is satisfied with the position of the interfacing edges of template 100 against his neck, he may commence to shaving the area below and up to the edge marking the boundary. In this view, user 301 is employing his right hand 302 to hold a wireless razor 304 to clean up beard and beard stubble beneath and up to the edge boundary that becomes the new beard line. The template covers the portion of the beard that is not shaved. As user 301 applies resistive force against the tensioning force of the elastic band, the force occurs mostly at the interfacing side of template 100 relative to edges 102, 103, and radiused edge 104 (edge 103 visible) and much less so on the outer edges 105 and 106. This effect pushes the interfacing edge standing on the neck leaving it in firm contact with radial conformity to the user's neck attributed to the flexibility of the template material. It is important to note here that the flexibility of the template is due to the L-shape design, the rigidity, and the thinness of the template. The flexibility of the template makes the surface of the template and the neck forming a roughly 90 degree while in tension which facilitates the trimming process along the edge of the template. The 90 degree angle may change depending on how tight the template is pulled by the straps.

Figure 5:
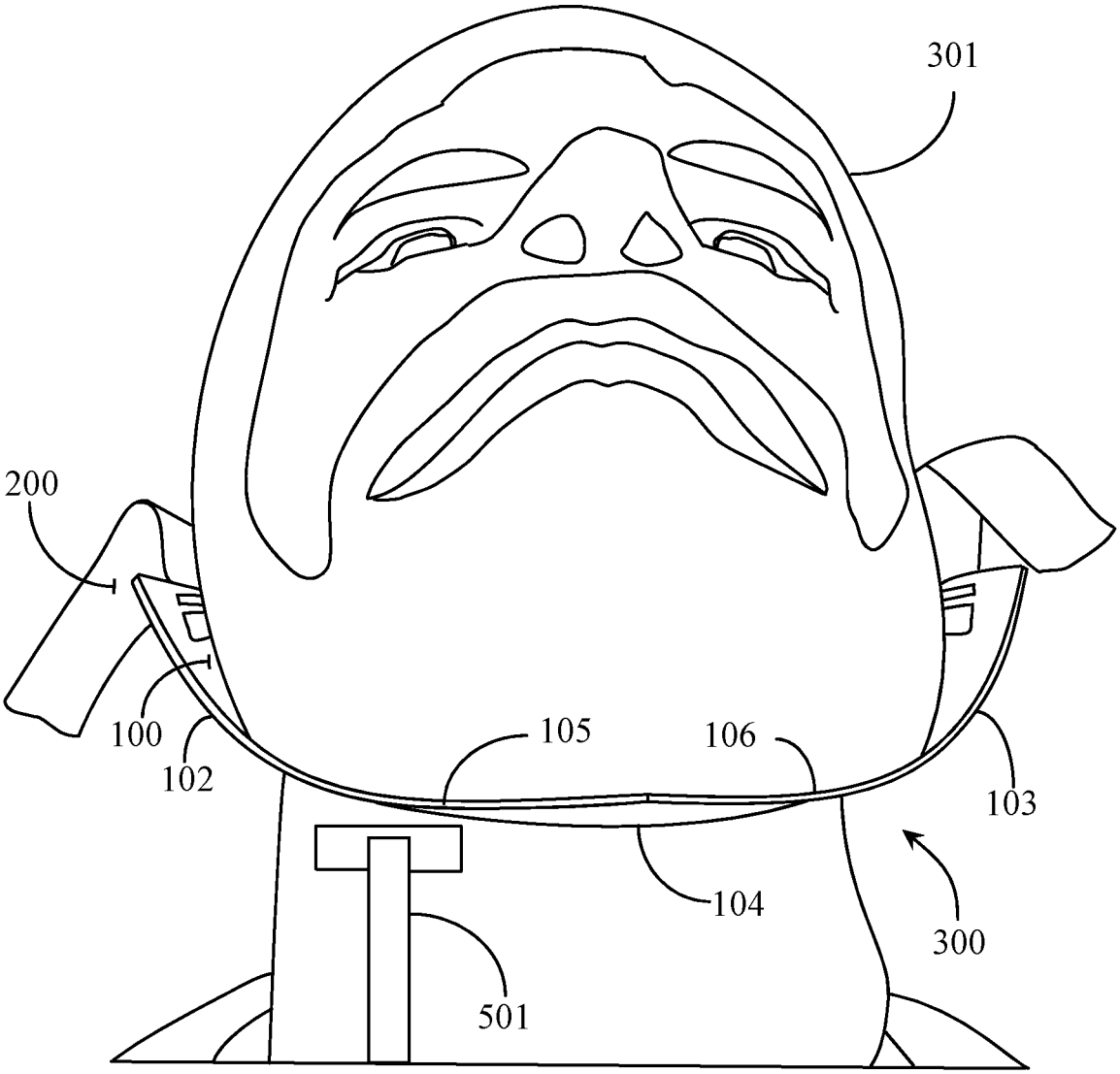
FIG. 5 is a front elevation view of the template apparatus of FIG. 3 worn in a hands-free fashion.

FIG. 5 is a front elevation view of template apparatus 300 of FIG. 3 worn and manipulated by user 301 engaged in shaping a beard neckline according to an embodiment of the present invention. In this view, the user's hand is not depicted so that the front view of template 100 is not obstructed. In this view, all interfacing edges of template 100 are visible, edge 102 on the right side, edge 103 on the left side, and radiused edge 104 at front and center.

It is important to note herein that the level of flexibility of the material making up template 100 applies along with the shape of the template interfacing side to provide edge conformity about the neck of user 301. In one embodiment, the material (101, FIG. 1) may exhibit a controlled level of elasticity like a rubberized material might. In such an embodiment, the conformity to form about the neck may be superior to that of a flexible plastic material that lacks elastic properties. More particularly, the elasticized template may have a thicker contact footprint about the user's neckline that includes a portion of the template surface away from the interfacing edges.

In one embodiment, template 100 is provided in more than one size. In one embodiment, template 100 may have an interfacing edge that is shaped to provide a symmetrical but not necessarily straight beard line whereas the interfacing edges may include radii, steps, or offset angles representing a stylistic edge for a beard. The material used to make template 100 may be transparent or opaque. Opaque templates may be of any planned color. In one embodiment, template 100 is provided in one size but includes two extra pairs of parallel slots (107, FIG. 1A) so the position of anchor of strap 200 may be changed relative to the ends of the template.

It will be understood that the inventive system has been described with reference to particular embodiments; however additions, deletions and changes could be made to these embodiments without departing from the scope of the inventive system. Although the systems that have been described include various components, it is well understood that these components and the described configuration can be modified and rearranged in various other configurations. The invention is limited only by the breadth of the claims below.

The invention claimed is:

1. A beard trimming template comprising;

a first elongated portion formed from a first straight edge having a first length, a and a second straight edge having a second length, the first and second straight edges positioned parallel to each other;

a second elongated portion having a third straight edge and a fourth straight edge, the third and fourth straight edges positioned parallel to each other; and a main body formed by a radius bridging ends of the second and third straight edges proximal to the main body, and an apex, opposite the radius, formed by ends of the first and fourth straight edges proximal to the main body joining at a right angle;

wherein the first and second straight edges are connected via a fifth straight edge forming a first width edge between the first and second straight edges and the third and fourth straight edges are connected via a sixth straight edge forming a second width edge, and wherein the first and second width edges are equal in dimension and are distal to the main body and wherein a strap is adhered to the template via attachment means, maintaining the template in position for use.

2. The template of claim 1, wherein the first and fourth straight edges are equal in length.

3. The template of claim 1, wherein the attachment means are positioned on the first and second elongated portion and include at least two slit openings at a position distal to the main body and parallel to the first and second width edges, the slit openings enabled to accept a separate end of the strap enabled to hold the template on a user's head.

4. The template of claim 1, wherein the strap is elastic.

5. The template of claim 1, wherein the template has a uniform thickness creating a radiused edge designed to be positioned adjacent to a user's neck under a user's chin.

6. The template of claim 5, wherein once positioned, the template maintains position without aid from the user.

7. The template of claim 1, wherein the template is manufactured from semi-rigid plastic or metal.

8. A method for using a hands-free beard trimming template, comprising the steps of:

creating a radiused edge on a main body, the radius having opposite ends, one each connected to separate ends of a first and third straight edge, the first and third straight edges positioned orthogonal to each other and extending away from the main body forming a first elongate member;

creating an apex opposite the radius of the main body by joining proximal ends of a first and fourth straight edge, the first and fourth straight edge positioned orthogonal to each other;

providing a first width edge joining ends of the first and second straight edges, the first width edge positioned distally from the main body;

providing a second width edge joining ends of the third and fourth straight edges, the second width edge positioned distally from the main body;

placing the radiused edge orthogonal and adjacent to a user's neck, under a chin of the user;

implementing a razor or other trimming device trimming a beard portion exposed by the template.

9. The method of claim 8, wherein an elastic strap is provided and attached to slit openings proximate to the first and second width edges enabling a user to use the razor to trim the beard while not holding the template.

10. The method of claim 9, wherein the template is manufactured from a semi-rigid plastic or metal.

* * * * *